US007946695B2

(12) United States Patent
Nozawa

(10) Patent No.: US 7,946,695 B2
(45) Date of Patent: May 24, 2011

(54) LIQUID CONTAINER, METHOD FOR PRODUCING LIQUID CONTAINER, AND INK-JET RECORDING APPARATUS USING LIQUID CONTAINER

(75) Inventor: Izumi Nozawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 908 days.

(21) Appl. No.: 11/697,017

(22) Filed: Apr. 5, 2007

(65) Prior Publication Data

US 2007/0236547 A1 Oct. 11, 2007

(30) Foreign Application Priority Data

Apr. 5, 2006 (JP) ..... 2006-104608

(51) Int. Cl.
*B41J 2/175* (2006.01)
*B41J 2/19* (2006.01)

(52) U.S. Cl. ..... 347/86; 347/92

(58) Field of Classification Search ..... 347/85, 347/86, 92
See application file for complete search history.

(56) References Cited

U.S. PATENT DOCUMENTS

| | | | | |
|---|---|---|---|---|
| 6,557,990 | B2 * | 5/2003 | Altendorf | 347/92 |
| 2004/0217127 | A1 * | 11/2004 | Kimura et al. | 222/92 |
| 2005/0204921 | A1 * | 9/2005 | Ishizawa et al. | 96/6 |

FOREIGN PATENT DOCUMENTS

JP 2005-169851 6/2005

* cited by examiner

*Primary Examiner* — Geoffrey Mruk
(74) *Attorney, Agent, or Firm* — Sughrue Mion, PLLC

(57) ABSTRACT

A liquid container includes a container body that stores liquid, a liquid-supplying section connected to an end of the container body and having a supply port for supplying the liquid stored in the container body to a liquid-consuming apparatus, and a decompressed space for absorbing gas dissolved in the liquid stored in the container body. The decompressed space is formed in the liquid-supplying section.

6 Claims, 7 Drawing Sheets

LIQUID CONTAINER, METHOD FOR PRODUCING LIQUID CONTAINER, AND INK-JET RECORDING APPARATUS USING LIQUID CONTAINER

CROSS-REFERENCE TO RELATED APPLICATIONS

This application claims priority from Japanese Patent Application 2006-104608, which is incorporated by reference herein, in its entirety.

BACKGROUND

1. Technical Field

The present invention relates to liquid containers having decompressed spaces for absorbing gas dissolved in liquid stored in the liquid containers, relates to methods for producing the liquid containers, and relates to ink-jet recording apparatuses using the liquid containers as ink packs.

2. Related Art

Typical, known liquid-consuming apparatuses include liquid-ejecting apparatuses that eject droplets from ejecting-heads. Typical liquid-ejecting apparatuses include ink-jet recording apparatuses that have ink-jet recording heads for recording images. Ink-jet recording apparatuses are widely used for printing including color printing. This popularity may be due to the relatively small amount of noise they produce during printing, and to their ability to produce small dots in high density.

In some liquid-consuming apparatuses, such as many ink-jet recording apparatuses, liquid is supplied to the liquid-consuming apparatuses from liquid containers that store liquid for use by the liquid-consuming apparatuses. In such arrangements, the liquid containers may be in the form of cartridges, detachable from the liquid-consuming apparatuses, and easily replaced by users when the liquid inside the liquid containers is exhausted.

In general, ink-jet recording apparatuses often include carriages having attached recording heads that discharge ink droplets and that reciprocate along recording surfaces of recording media. In some methods of supplying ink from ink cartridges to the recording heads, the ink cartridges are attached to the carriages, and ink is supplied to the recording heads from the ink cartridges, which reciprocate together with the recording heads. On the other hand, in some methods of supplying ink, the ink cartridges are attached to casings or the like of the apparatus bodies, and ink is supplied from the ink cartridges to the recording heads via ink channels formed of flexible tubes or the like.

When ink cartridges filled with ink are left to stand for a long period of time, $N_2$ is sometimes generated by chemical changes of pigments in the ink. Moreover, $N_2$, $O_2$, and the like can enter from outside through walls of the ink containers such as cartridges when they have a poor gas-barrier property.

If printing is performed, and large amounts of $N_2$ and $O_2$ are dissolved in the ink inside the ink cartridges, bubbles can be generated in the ink due to pressure changes during ink discharge and the like. Such bubbles can block the ink channels, and can cause discharge failure. This degrades printing quality.

To solve the above-described problems, an ink cartridge having the structure shown in FIG. 6 has been already proposed. An ink cartridge 101 described in JP-A-2005-169851 includes an ink pack (liquid container) 102 that stores ink and a rigid case 150 that accommodates the ink pack 102. The case 150 includes an open-top case body 150A and a cover 150B sealing the top opening of the case body 150A. Moreover, there is a circuit board 151 including an integrated circuit (IC) such as a semiconductor storage cell for storing information such as ink types, ink levels, and the like, disposed at a side surface of the case 150.

The ink pack 102 includes a liquid-containing bag (container body) 103 formed of a flexible-film bag for storing ink, an ink-supplying section (liquid-supplying section) 104 connected to an end of the liquid-containing bag 103 and having an ink-supply port (liquid-supply port) for supplying ink from the liquid-containing bag 103 to a recording apparatus, and a gas-absorbing device 105 for absorbing gases such as $N_2$ and $O_2$ dissolved in the ink stored inside the liquid-containing bag 103. The supply port of the ink-supplying section 104 is sealed with a supply-port film 40 before the ink pack 102 is used.

As shown in FIG. 7, a spring 106 and a valve element 107 urged by the spring 106 are disposed inside the ink-supplying section 104 at an outer end portion of the ink-supplying section 104, and a seal 108 is attached to the outer end of the ink-supplying section 104. Moreover, a valve element 109 is disposed inside the ink-supplying section 104 at an inner end portion of the ink-supplying section 104, and a check-valve cover 110 is attached to the inner end of the ink-supplying section 104. The check-valve cover 110 is formed separately from the ink-supplying section 104, and is integrated afterward with the ink-supplying section 104, using thermal caulking.

The spring 106, the valve element 107, and the seal 108 function as an on-off valve that opens a flow channel only when predetermined flow-channel means is connected to the supply port. The valve element 109 and the check-valve cover 110 constitutes a check valve 117 that opens the flow channel only when the liquid flows in a direction from the liquid-containing bag 103 to the outside.

As shown in FIG. 7, the gas-absorbing device 105 includes a decompressed container 112 having an opening 111 at an end thereof, and a flexible film 113 that closes the opening 111 while the interior of the decompressed container 112 is decompressed. With this, the interior of the decompressed container 112 is defined as a decompressed space **105*a* for absorbing gases such as $N_2$ and $O_2$ dissolved in the ink. This gas-absorbing device 105 is formed separately from the liquid-containing bag 103 and the ink-supplying section 104, and is connected to the ink-supplying section 104 by fitting claws 115 formed at the inner end of the ink-supplying section 104 into catching portions 116 formed at the end of the decompressed container 112. The gas-absorbing device 105 is then disposed inside the liquid-containing bag 103**.

This gas-absorbing device 105 receives the pressure inside the decompressed space **105*a* using the inner surfaces thereof, and at the same time, at least part of partition walls of the outer surfaces of the gas-absorbing device 105 (the partition walls being in contact with the ink inside the liquid-containing bag 103) is composed of a gas-permeable material through which gases dissolved in the ink inside the liquid-containing bag 103** can permeate.

Due to the decompressed space **105*a*, which is brought into contact with the ink inside the ink pack 102 as described above, for example, gases permeating from outside through the liquid-containing bag 103 and dissolved in the ink can be collected in the decompressed space 105*a***. This can prevent problems such as discharge failure caused by bubbles dissolved in the ink.

However, in the above-described ink pack 102, the decompressed space **105*a* for removing gases dissolved in the ink is provided by the gas-absorbing device 105, which is an independent and dedicated component. This leads to an increase in the number of parts, an additional assembling process for connecting the gas-absorbing device 105 to the ink-supplying section 104, and thus an increase in the cost of the ink pack 102. Moreover, the catching portions 116 and the claws 115 for connecting the ink-supplying section 104 and the gas-absorbing device 105 result in the structures of these components becoming more complex. Furthermore, according to a method of producing the above-described ink pack 102, for example, the opening of the decompressed container 112 is sealed with the flexible film 113 under a dedicated vacuum environment. After the gas-absorbing device 105 having the decompressed space 105***a* is formed, the gas-absorbing device 105 and the ink-supplying section 104 are assembled together, and then the gas-absorbing device 105 is fitted into the liquid-containing bag 103. Through these steps, the final structure having the decompressed space 105*a* sealed inside the liquid-containing bag 103 is formed. However, when the decompressed space 105*a* is exposed under an atmospheric-pressure environment before the final structure is formed, gases in the air can be absorbed in the decompressed space 105*a*, thereby causing a deterioration in the gas-absorption performance of the decompressed space 105*a*.

SUMMARY

An advantage of some aspects of the invention is the provision of a liquid container having a decompressed space for absorbing and removing gas dissolved in liquid that is stored in the liquid container without increasing the number of parts and assembling steps, and capable of preventing problems caused by gas dissolved in the stored liquid, at low cost. Moreover, another advantage of some aspects of the invention is the provision of a method for efficiently producing a liquid container with a relatively small number of steps. Furthermore, yet another advantage of some aspects of the invention is the provision of a highly reliable ink-jet recording apparatus capable of preventing discharge failure, of ink or the like, so as to maintain high-precision recording in a system that uses a liquid container.

A liquid container according to a first aspect of the invention includes a container body that stores liquid, a liquid-supplying section connected to an end of the container body and having a supply port for supplying the liquid stored in the container body to a liquid-consuming apparatus, and a decompressed space for absorbing gas dissolved in the liquid stored in the container body. The decompressed space is formed in the liquid-supplying section.

According to the above-described liquid container, the decompressed space for absorbing and removing the gas dissolved in the liquid that is stored in the liquid container, is formed in the liquid-supplying section, connected to the end of the container body, that stores liquid and having the supply port for supplying the liquid to a liquid-consuming apparatus. Therefore, the decompressed space does not cause an increase in the number of parts or in the number of assembling steps as compared with a case where such a decompressed space is formed in an independent part separate from the liquid-supplying section and the container body.

The container body is preferably formed of a liquid-containing bag. Moreover, the liquid-supplying section preferably includes a first tube disposed adjacent to a base of the liquid-supplying section, the first tube being fitted into the liquid-containing bag, and preferably includes a recessed portion formed on an outer periphery of the first tube at a position remote from an edge of the liquid-containing bag toward the interior of the liquid-containing bag by a predetermined distance. Furthermore, the liquid-containing bag located over the recessed portion is preferably welded to a peripheral portion of the recessed portion so as to form an enclosed space serving as the decompressed space.

According to the above-described liquid container, the peripheral portion of the recessed portion is hermetically sealed by the liquid-containing bag when the first tube of the liquid-supplying section is fitted into the end of the liquid-containing bag and the area of the outer periphery of the liquid-supplying section more adjacent to the head than the recessed portion is welded to the liquid-containing bag. The liquid-containing bag is evacuated to a predetermined vacuum before injecting liquid into the liquid-containing bag, and then the liquid-containing bag is welded to the peripheral portion of the recessed portion. Thus, the decompressed space can be relatively easily formed. Subsequently, liquid is injected into the liquid-containing bag without leaving the decompressed space in an air atmosphere. With this, the decompressed space in a form capable of absorbing the gas dissolved in the stored liquid can be quickly formed.

It is preferable that the liquid-supplying section further includes a second tube disposed adjacent to a head of the liquid-supplying section, the second tube being connected to the first tube and protruding from the liquid-containing bag; a flow channel connecting a supply port formed at a head end of the second tube and a discharge port formed at a base end of the first tube so as to guide the liquid inside the liquid-containing bag to the outside; a check valve disposed on the flow channel adjacent to the discharge port so as to prevent back-flow of the liquid from the supply port to the discharge port; a bypass channel branched from the flow channel at a position between the check valve and the supply port and having an opening formed on the outer periphery of the first tube; and an on-off valve disposed at the supply port so as to open the flow channel only when predetermined flow-channel means is connected to the supply port.

According to a second aspect of the invention, a method for producing the above-described liquid container includes primary welding in which the first tube of the liquid-supplying section is fitted into the end of the liquid-containing bag, and an edge portion of the liquid-containing bag that is more adjacent to the supply port than the opening of the bypass channel and the recessed portion is welded to the first tube so as to hermetically close the interior of the liquid-containing bag; decompressing in which the pressure inside the liquid-containing bag and the recessed portion is reduced to a predetermined level via the bypass channel and the discharge port using a vacuum suction unit connected to the supply port after the primary welding; decompressed-space forming in which the liquid-containing bag located over the recessed portion is welded to the peripheral portion of the recessed portion so as to form the decompressed space after decompressing; liquid charging in which the liquid-containing bag is filled with liquid via the bypass channel using a liquid-injecting unit connected to the supply port after the decompressed-space forming; and bypass closing in which the liquid-containing bag located over the opening of the bypass channel is welded to a peripheral portion of the opening so as to close the bypass channel after the liquid charging.

According to the above-described method, the decompressed space in a predetermined vacuum state can be easily formed during the decompressed-space forming in a series of a working process for injecting liquid into the liquid-containing bag. Moreover, the decompressed space in a form capable of absorbing the gas dissolved in the liquid stored in the liquid-containing bag can be formed by quickly conducting the liquid charging and the bypass closing after the decompressed-space forming without the degradation of the gas-absorption performance of the decompressed space caused by leaving the decompressed space in an air atmosphere. In this manner, the liquid container can be efficiently produced with a small number of steps.

It is preferable that the liquid charged during the liquid charging is ink that is supplied to an ink-jet recording apparatus, and the liquid container is an ink pack installed in the ink-jet recording apparatus.

According to the above-described method, an ink pack capable of absorbing and removing the gas dissolved in the ink stored in the liquid-containing bag thereof using the decompressed space and capable of maintaining the ink in a high-quality state can be efficiently produced.

According to a third aspect of the invention, an ink-jet recording apparatus includes a cartridge-holding section and an ink cartridge. The ink cartridge accommodates the ink pack formed using the method for producing the above-described liquid container, and is installed in the cartridge-holding section.

According to the above-described ink-jet recording apparatus, the ink stored in the ink pack can be maintained in a high-quality state having no dissolved gas due to the decompressed space formed in the ink pack. Accordingly, problems such as ink-discharge failure caused by dissolved gas can be prevented, and high-precision recording can be maintained for a long period of time.

In accordance with the liquid container according to the first aspect of the invention, the decompressed space for absorbing and removing the gas dissolved in the liquid stored in the liquid container is formed in the liquid-supplying section connected to the end of the container body that stores liquid. Therefore, the decompressed space does not cause an increase in the number of parts or in the number of assembling steps as compared with a case where such a decompressed space is formed in an independent part separate from the liquid-supplying section and the container body.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
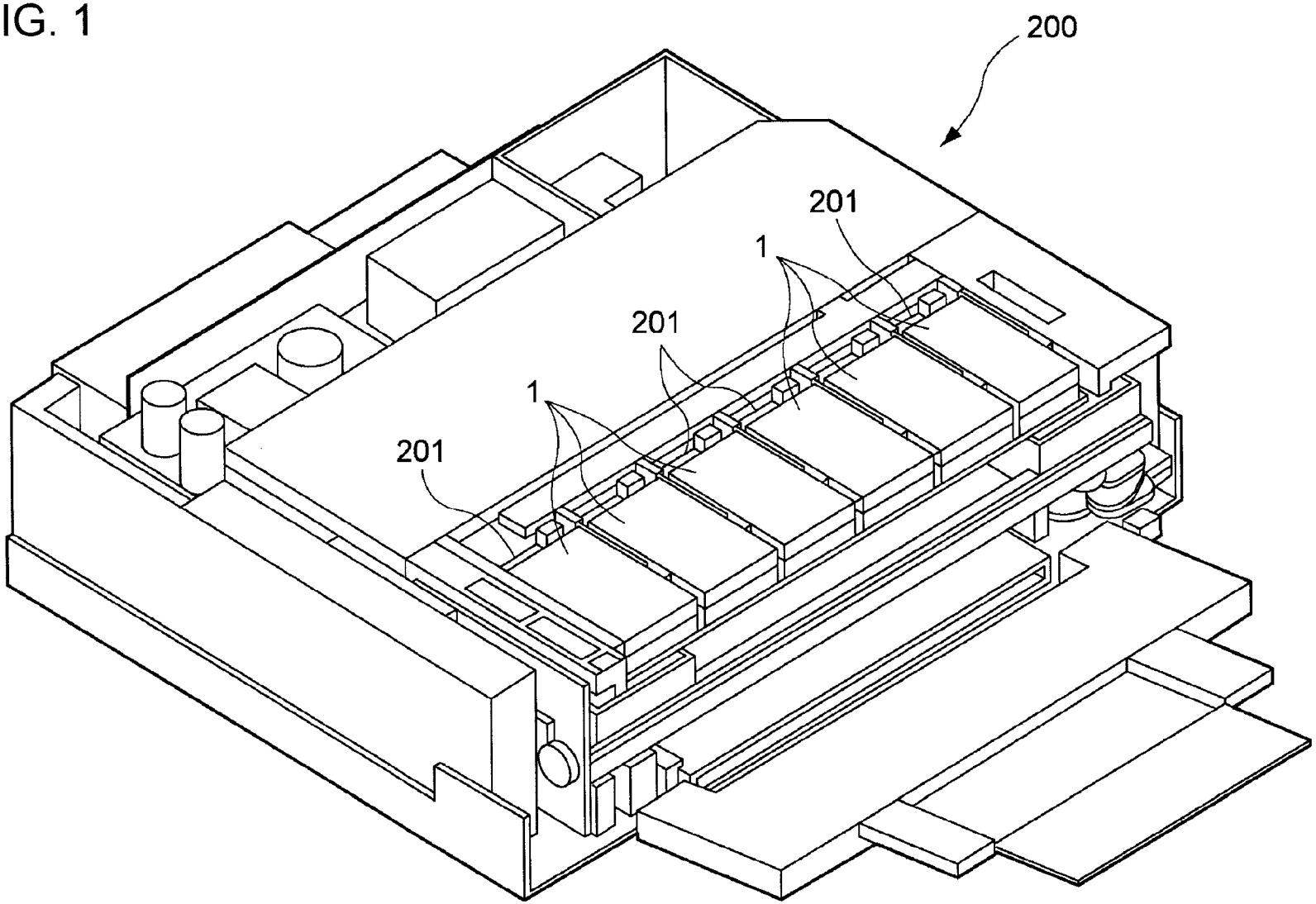
FIG. 1 is a perspective view of an ink-jet recording apparatus serving as a liquid-consuming apparatus using a liquid container according to an embodiment of the invention.
Figure 2:
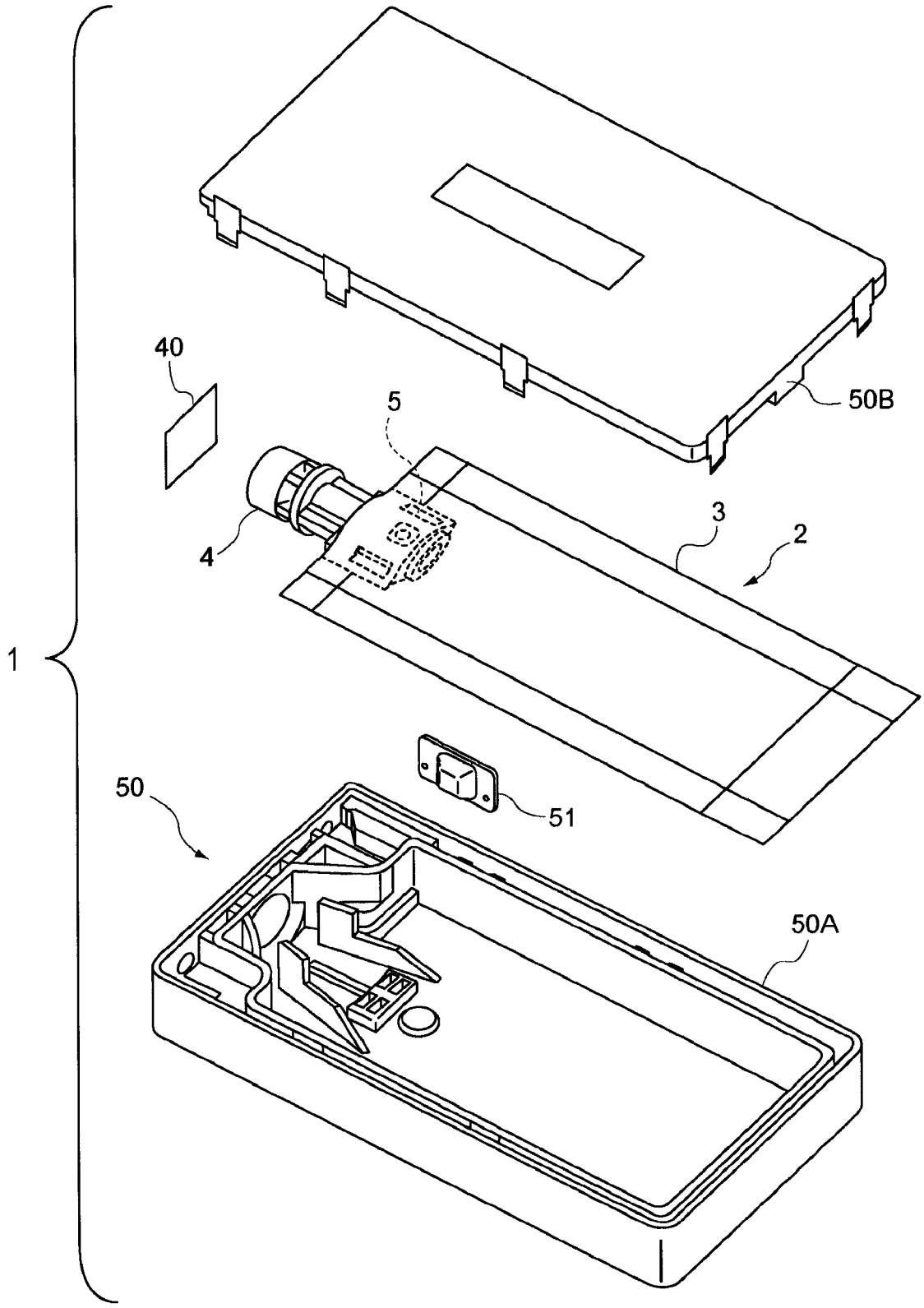
FIG. 2 is an exploded perspective view of an ink cartridge installed in the ink-jet recording apparatus shown in FIG. 1.

A liquid container according to a preferred embodiment of the invention will now be described in detail with reference to the drawings. FIG. 1 is a perspective view of an ink-jet recording apparatus serving as a liquid-consuming apparatus using a liquid container according to an embodiment of the invention. FIG. 2 is an exploded perspective view of an ink cartridge installed in the ink-jet recording apparatus shown in FIG. 1.

An ink-jet recording apparatus 200 shown in FIG. 1 has cartridge-holding sections 201 disposed in an upper portion adjacent to the front surface thereof. Ink cartridges 1 are installed in the cartridge-holding sections 201 so as to be detachable. In this embodiment, six cartridge-holding sections 201 are aligned on the same horizontal plane, and six ink cartridges 1 are arranged in a line.

As shown in FIG. 2, each of the ink cartridges 1 includes an ink pack (liquid container) 2 that stores ink and a rigid case 50 that accommodates the ink pack 2. The case 50 includes an open-top case body 50A and a cover 50B sealing the top opening of the case body 50A. Moreover, a circuit board 51 including an IC (semiconductor storage cell) for storing information such as ink types, ink levels, and the like is disposed at a side surface of the case 50.

The ink pack 2 serving as a liquid container according to this embodiment of the invention includes a liquid-containing bag 3 serving as a container body formed of a flexible-film bag for storing ink, an ink-supplying section 4 serving as a liquid-supplying section connected to an end of the liquid-containing bag 3 and having an ink-supply port (liquid-supply port) for supplying ink from the liquid-containing bag 3 to the ink-jet recording apparatus 200, and decompressed spaces 5 for absorbing gases such as $N_2$ and $O_2$ dissolved in the ink stored inside the liquid-containing bag 3. A supply port 4*a* (seen in FIG. 3A) of the ink-supplying section 4 disposed at the head of the ink-supplying section 4 is sealed with a supply-port film 40 before the ink pack 2 is used.

Figure 3A:
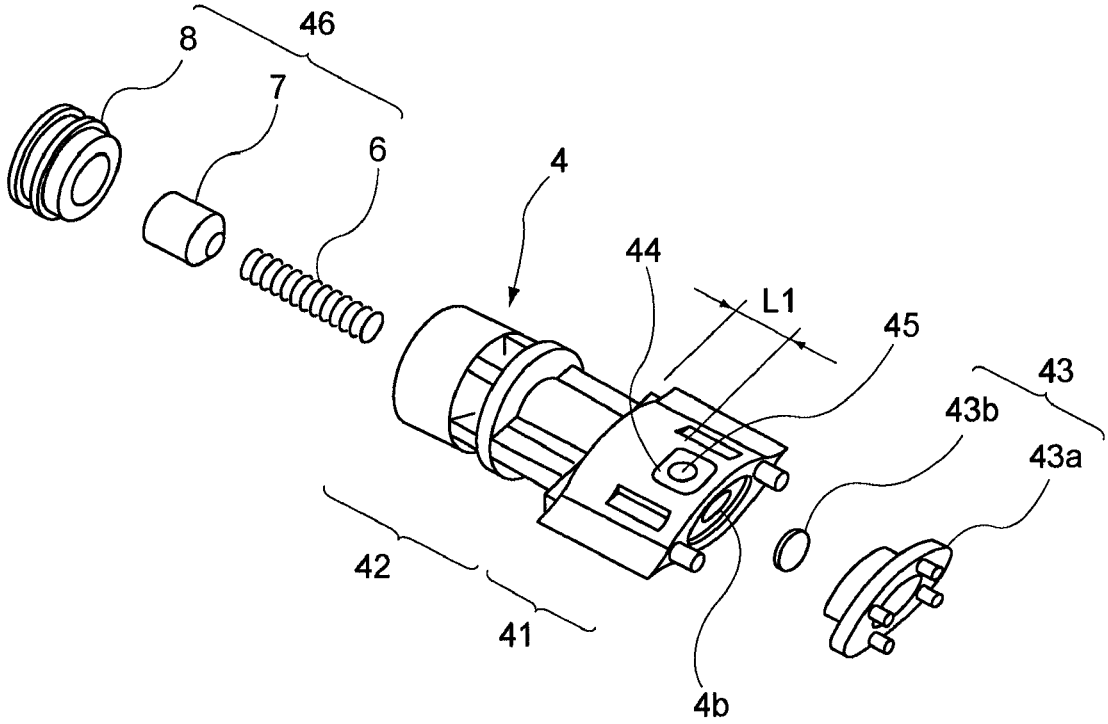
FIGS. 3A and 3B are exploded perspective views of an ink-supplying section shown in FIG. 2 viewed from the base and the head thereof, respectively.
Figure 3B:
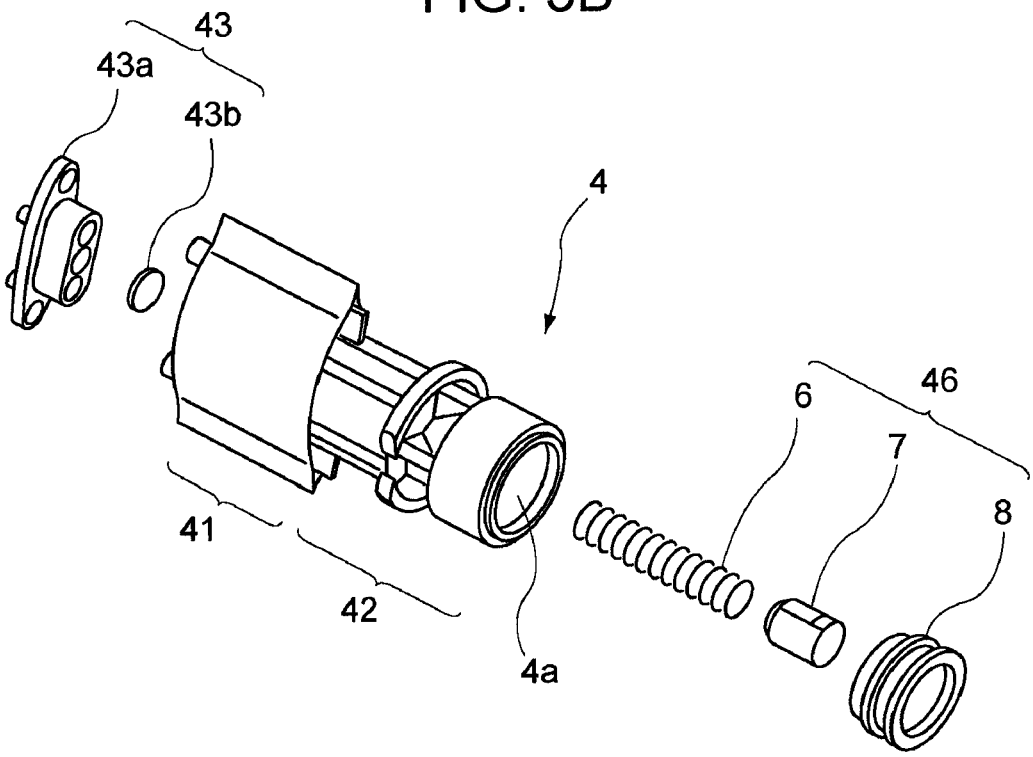

As shown in FIGS. 3A and 3B, the ink-supplying section 4 includes a first tube 41 adjacent to the base of the ink-supplying section 4 fitted into the liquid-containing bag 3 and a second tube 42 adjacent to the head of the ink-supplying section 4 connected to the first tube 41 and protruding from the liquid-containing bag 3. The first and second tubes are composed of resin, and formed by injection molding so as to be integrated with each other. The second tube 42 has a supply port 4*a* for supplying ink at the end thereof, the supply port 4*a* being connected to predetermined flow-channel means such as an ink-supplying needle provided for the cartridge-holding sections 201 of the ink-jet recording apparatus 200. Moreover, the first tube 41 has a discharge port 4*b* that is open toward the interior of the liquid-containing bag 3 at the base thereof.

Moreover, the ink-supplying section 4 includes a flow channel (not shown) formed inside thereof connecting the supply port 4*a* of the second tube 42 and the discharge port 4*b* of the first tube 41 so as to guide the liquid inside the liquid-containing bag 3 to the outside, a check valve 43 disposed on the flow channel adjacent to the discharge port so as to prevent backflow of the ink from the supply port 4*a* to the discharge port 4*b*, a bypass channel 45 branched from the flow channel at a position between the check valve 43 and the supply port 4*a* and having an opening 44 formed on the outer periphery of the first tube 41 at a position remote from the edge of the liquid-containing bag 3, toward the interior of the liquid-containing bag 3, by a predetermined distance L1, and an on-off valve 46 disposed at the supply port 4*a* so as to open the flow channel only when predetermined flow-channel means such as an ink-supplying needle and an ink-injecting needle is connected.

The check valve 43 disposed on the flow channel adjacent to the discharge port includes a valve-supporting cover 43*a* formed separately from the ink-supplying section 4 and fixed to the end of the first tube 41 by thermal caulking, and a valve element 43*b* supported inside the valve-supporting cover 43*a*. The valve element 43*b* closes the flow channel such that the ink does not flow backward from the supply port 4*a* to the liquid-containing bag 3. The on-off valve 46 attached to the supply port 4*a* includes a spring 6 fitted into the supply port 4*a* while it is compressed, a valve element 7 urged so as to protrude from the supply port 4*a* by the spring 6, and a seal 8 attached to the supply port 4*a* and maintaining the flow channel closed using the valve element 7 that is pressed into contact with the seal 8.

Figure 4:
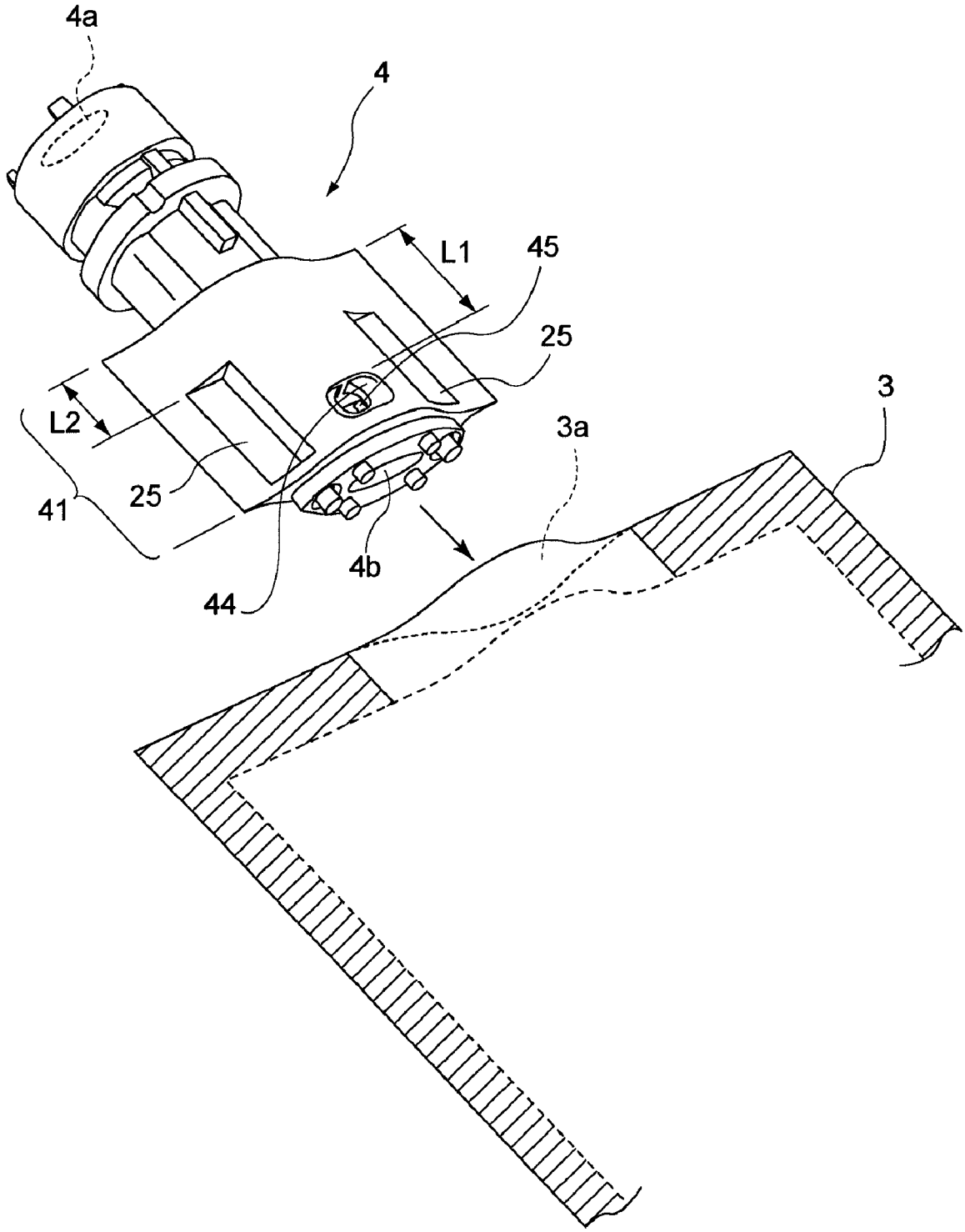
FIG. 4 is an exploded perspective view of the ink-supplying section and a liquid-containing bag of an ink pack shown in FIG. 2.

As shown in FIG. 4, the first tube 41 of the ink-supplying section 4 has a spindle-shaped cross section whose thickness is gradually reduced from the center toward both ends such that the edge of the liquid-containing bag 3 located over the first tube 41 can easily stick to the first tube 41. Moreover, a pair of recessed portions 25 that forms the decompressed spaces 5 is formed on the outer periphery of the first tube 41 having the opening 44 of the bypass channel 45 at a position remote from the edge of the liquid-containing bag 3 toward the interior of the liquid-containing bag 3 by a predetermined distance L2. The decompressed spaces 5 can be formed by through-holes that pass through the first tube 41 of the ink-supplying section 4 instead of the recessed portions 25.

In the case of the ink pack 2 according to this embodiment, the first tube 41 of the ink-supplying section 4 is fitted into an opening 3*a* for port connection formed at an end of the liquid-containing bag 3 as shown in FIG. 4, and the liquid-containing bag 3 located over the recessed portions 25 is welded to the peripheral portions of the recessed portions 25 so as to form enclosed spaces serving as the decompressed spaces 5.

Figure 5A:
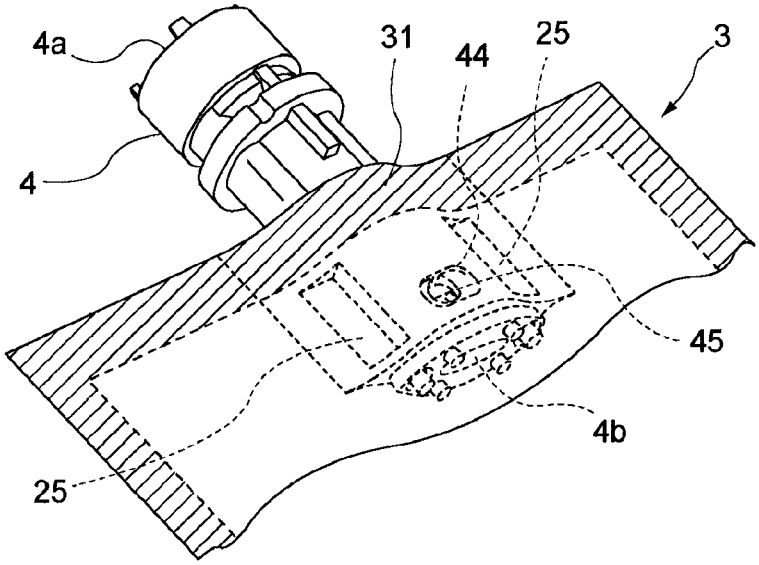
FIGS. 5A, 5B, and 5C illustrate a manufacturing process of the ink pack shown in FIG. 2.
Figure 5B:
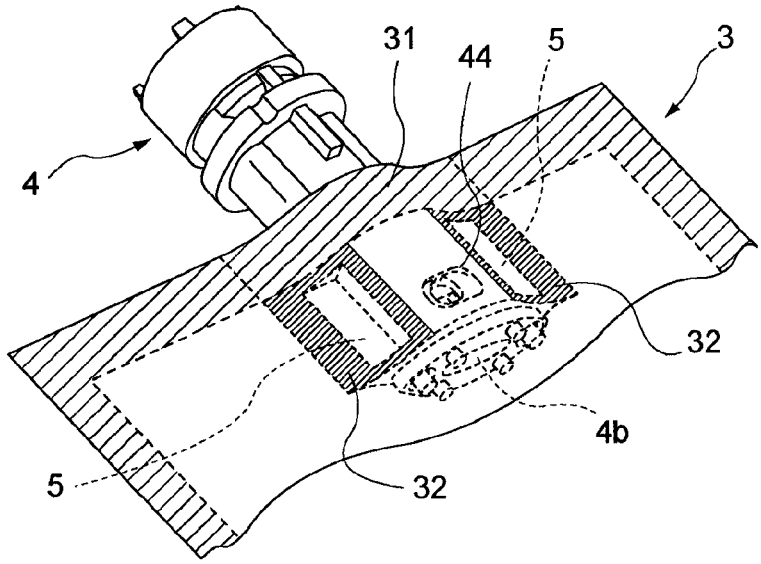
Figure 5C:
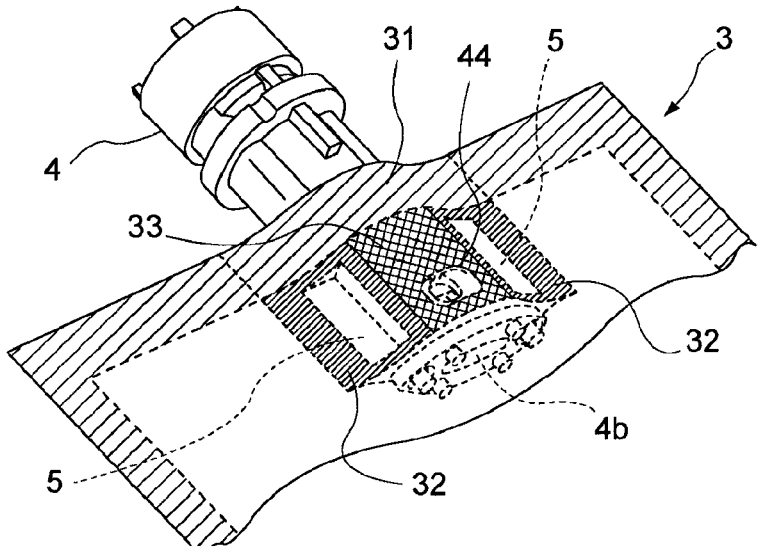
Figure 6:
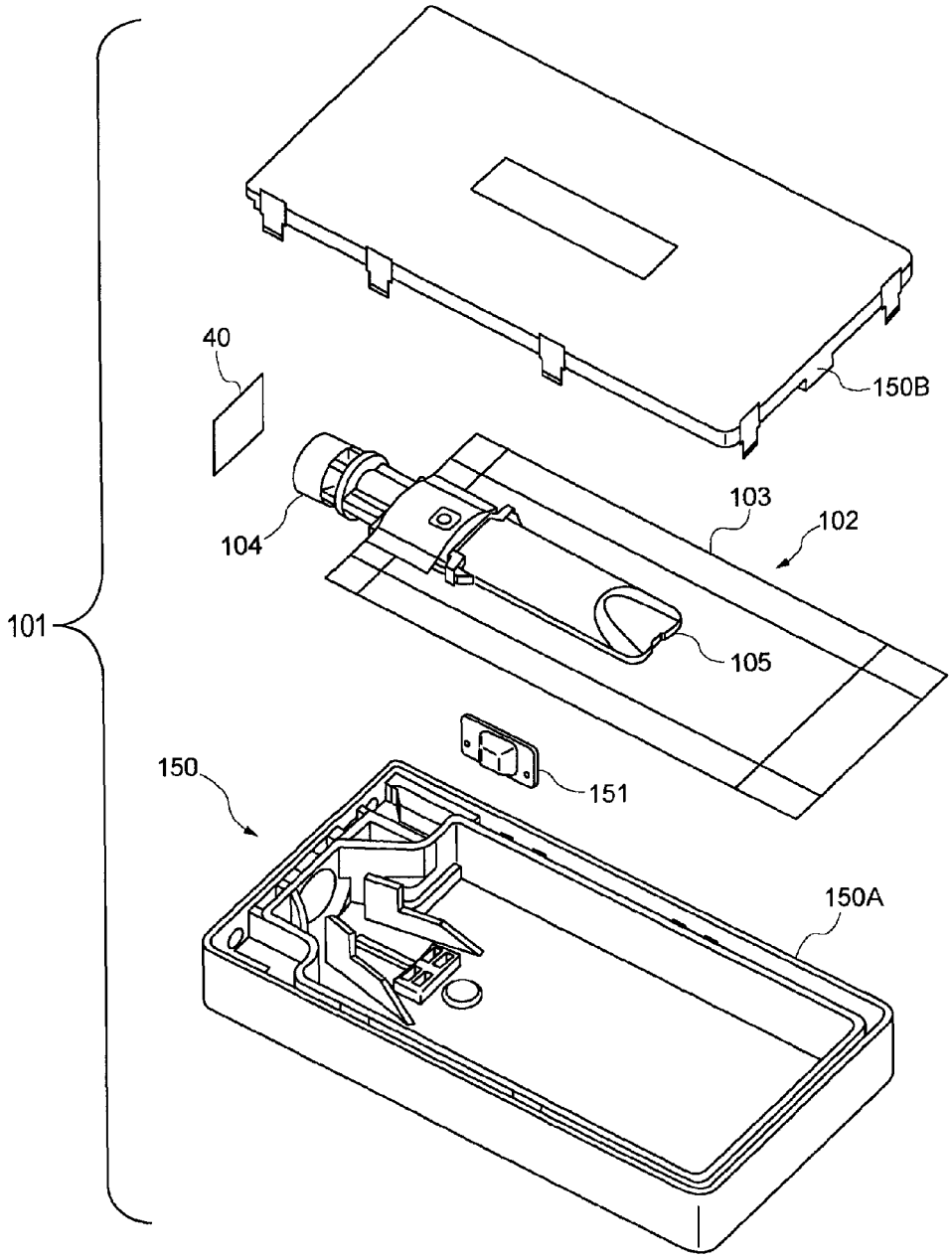
FIG. 6 RELATED ART
FIG. 6 is an exploded perspective view of an ink cartridge having an ink pack serving as a liquid container known to the inventors.
Figure 7:
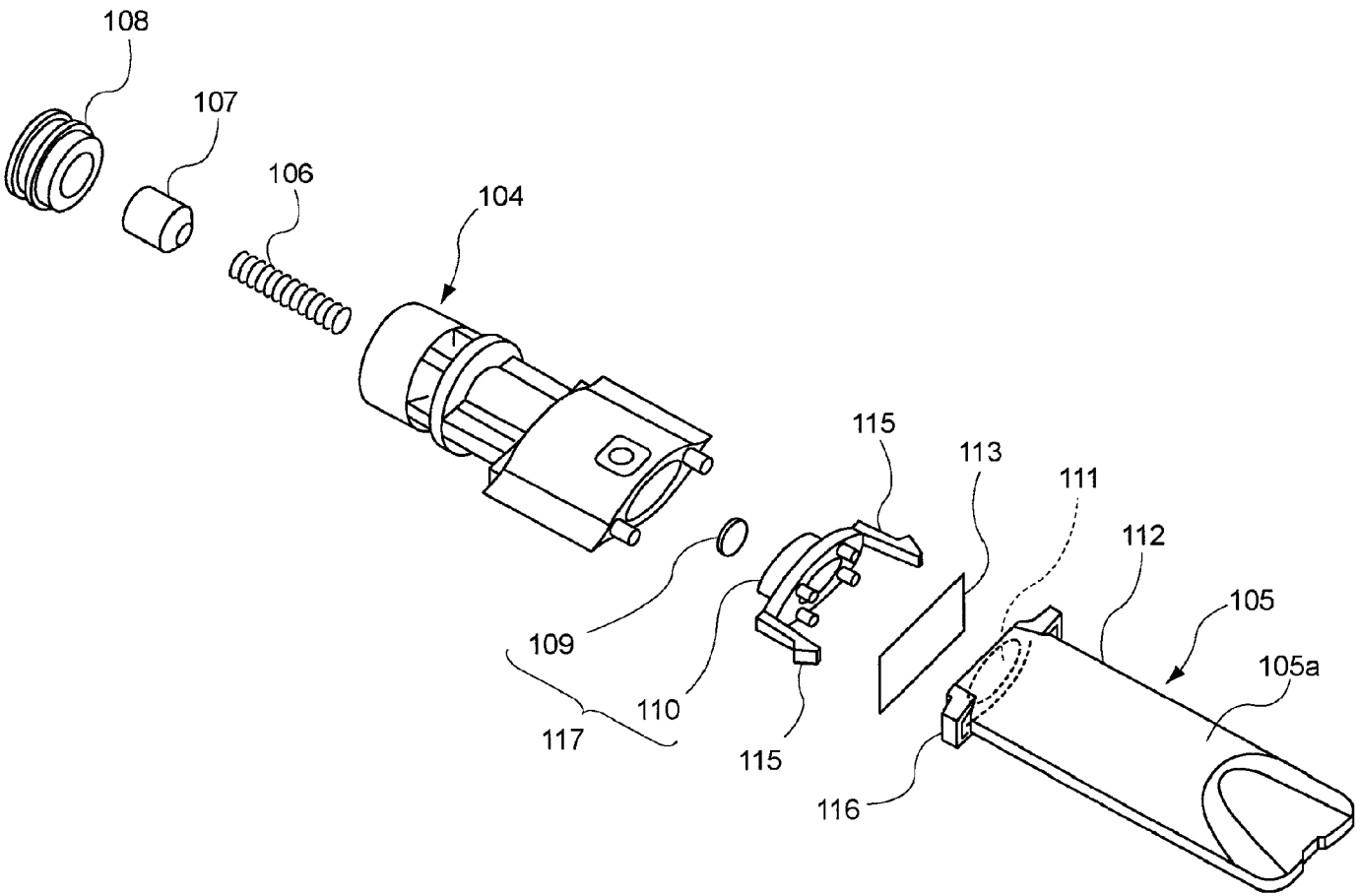
FIG. 7 RELATED ART
FIG. 7 is an exploded perspective view of an ink-supplying section and a gas-absorbing device of the ink pack shown in FIG. 6.

Next, a method for producing the ink pack 2 by welding the liquid-containing bag 3 to the ink-supplying section 4 will be described with reference to FIGS. 5A to 5C. In FIGS. 5A to 5C, hatched areas of the liquid-containing bag 3 are portions to be welded. First, as shown in FIG. 5A, the first tube 41 of the ink-supplying section 4 is fitted into the opening 3*a* formed at the end of the liquid-containing bag 3, and edge portions 31 of the liquid-containing bag 3 that are more adjacent to the supply port 4*a* than the opening 44 of the bypass channel 45 and the recessed portions 25 are welded to the first tube 41. With this, the interior of the liquid-containing bag 3 is hermetically closed (primary welding step). After the primary welding step, the pressures inside the liquid-containing bag 3 and the recessed portions 25 are reduced to predetermined levels using a vacuum suction unit connected to the supply port 4*a* via the bypass channel 45 (decompressing step). After the decompressing step, the interior of the liquid-containing bag 3 including the spaces formed by the recessed portions 25 is evacuated to a predetermined vacuum.

After the decompressing step, areas 32 of the liquid-containing bag 3 located over the recessed portions 25 are welded to the peripheral portions of the recessed portions 25 as shown in FIG. 5B. With this, the decompressed spaces 5 are formed (decompressed-space-forming step). The liquid-containing bag 3 is not welded to the peripheral portion of the opening 44 of the bypass channel 45 during this decompressed-space-forming step, and the interior of the liquid-containing bag 3 can communicate with the exterior of the liquid-containing bag 3 via the bypass channel 45.

After the decompressed-space-forming step, the liquid-containing bag 3 is filled with a predetermined amount of ink via the bypass channel 45 using a liquid-injecting unit connected to the supply port 4*a* (liquid-charging step). After the liquid-charging step, an area 33 of the liquid-containing bag 3 located over the opening 44 of the bypass channel 45 is welded to the peripheral portion of the opening 44 as shown in FIG. 5C so as to close the bypass channel 45, i.e., disconnect the interior of the liquid-containing bag 3 from the supply port 4*a* (bypass-closing step).

In the decompressed spaces 5 of the ink pack 2 produced in the above-described manner, part of the outer wall of the first tube 41 forming the recessed portions 25 and brought into contact with the ink stored in the liquid-containing bag 3 is composed of a gas-permeable material. Thus, the decompressed spaces 5 can absorb gases such as $N_2$ and $O_2$ dissolved in the ink when the decompressed spaces 5 are brought into contact with the ink stored in the liquid-containing bag 3 via partitions composed of a gas-permeable material.

The gas-permeable material used in the part of the partitions defining the decompressed spaces 5 includes thermoplastic resins, and is preferably any one of polypropylene, polyethylene, and polystyrene. These thermoplastic resins hardly react chemically with ink, and furthermore, have appropriate gas permeability.

The liquid-containing bag 3 of the ink pack 2 is formed of a flexible film composed of a material having a gas permeability lower than that of the gas-permeable material used for at least part of the partitions defining the decompressed spaces 5. More specifically, the liquid-containing bag 3 is formed of monolayer films or laminated films including at least one of an aluminum-laminated film, a silica-evaporated film, and an alumina-evaporated film.

Since the liquid-containing bag 3 of the ink pack 2 is formed of a flexible film composed of a material having a gas permeability lower than that of the gas-permeable material used for at least part of the partitions defining the decompressed spaces 5 in this manner, gases permeating through the liquid-containing bag 3 of the ink pack 2 and dissolved in the ink can be reliably absorbed in the decompressed spaces 5.

In the above-described ink pack 2 according to this embodiment, the decompressed spaces 5 for absorbing and removing gases such as $N_2$ and $O_2$ dissolved in the ink stored in the ink pack 2 are formed in the ink-supplying section 4 that is connected to the end of the liquid-containing bag 3 so as to supply the ink stored in the liquid-containing bag 3 to the ink-jet recording apparatus 200. Therefore, the decompressed spaces 5 do not cause an increase in the number of parts or in the number of assembling steps as compared with a case where such decompressed spaces are formed in an independent part separate from an ink-supplying section and a liquid-containing bag. Thus, the decompressed spaces 5 can be formed at low cost, and problems caused by gases dissolved in the stored ink can be prevented at low cost. Moreover, the structure of the ink-supplying section 4 can be simplified since no engaging portions for connecting an independent gas-absorbing device are required for the ink-supplying section 4. This leads to an increase in the productivity of the ink-supplying section 4.

Moreover, in the ink pack 2 according to this embodiment, the liquid-containing bag 3 is formed of a flexible-film bag. Therefore, when the first tube 41 of the ink-supplying section 4 is fitted into the end of the liquid-containing bag 3 and areas of the outer periphery of the ink-supplying section 4 more adjacent to the head than the recessed portions 25 are welded to the liquid-containing bag 3, the peripheral portions of the recessed portions 25 are hermetically sealed by the liquid-containing bag 3. The liquid-containing bag 3 is evacuated to a predetermined vacuum before injecting ink into the liquid-containing bag 3, and then the liquid-containing bag 3 is welded to the peripheral portions of the recessed portions 25. With this, the decompressed spaces 5 can be easily formed.

Subsequently, ink is injected into the liquid-containing bag 3 without leaving the decompressed spaces 5 in an air atmosphere. With this, the decompressed spaces 5 in a form capable of absorbing the gases dissolved in the stored ink can be quickly formed. That is, the decompressed spaces 5 can be easily formed in a series of a working process for injecting ink into the liquid-containing bag 3, and the decompressed spaces 5 in a form capable of quickly absorbing the gases dissolved in the stored ink can be formed. Therefore, a reduction in the gas-absorption performance caused when the decompressed spaces 5 absorb gases in the air before being formed can be prevented.

Moreover, according to the method for producing the ink pack 2 shown in FIGS. 5A to 5C, during the decompressed-space-forming step in the series of the working process for injecting ink into the liquid-containing bag 3 connected to the ink-supplying section 4. Moreover, the decompressed spaces 5 in a form capable of absorbing gases dissolved in the ink stored in the liquid-containing bag 3 can be formed by quickly conducting the ink-charging step and the bypass-closing step after the decompressed-space-forming step without the degradation of the gas-absorption performance of the decompressed spaces 5 caused by leaving the decompressed spaces 5 in an air atmosphere. In this manner, the ink pack 2 can be efficiently produced with a small number of steps.

In an ink-jet recording apparatus employing the cartridge-holding sections 201 that hold the ink packs 2 as in the ink-jet recording apparatus 200 according to the above-described embodiment, ink stored in the ink packs 2 can be maintained in a high-quality state having no dissolved gases due to the decompressed spaces 5 formed in the ink packs 2. Accordingly, problems such as ink-discharge failure caused by dissolved gases can be prevented, and high-precision recording can be maintained for a long period of time.

The liquid container according to the invention is not limited to ink packs used in ink-jet recording apparatuses. The liquid container according to the invention can be applied to various liquid containers that store liquid, prevention of gas dissolution into the liquid being required. Moreover, various liquid-ejecting apparatuses other than the ink-jet recording apparatus shown in the above-described embodiment can be intended as liquid-consuming apparatuses using the liquid containers.

What is claimed is:

1. A liquid container comprising:

a container body that stores liquid;

a liquid-supplying section connected to an end of the container body and having a supply port for supplying the liquid stored in the container body to a liquid-consuming apparatus; and a decompressed space for absorbing gas dissolved in the liquid stored in the container body;

wherein the decompressed space is formed in the liquid-supplying section, wherein the decompressed space is defined by a partition composed of a gas-permeable material, wherein a recessed portion is formed on an outer periphery of the liquid-supplying section, and wherein a liquid-containing bag is welded to a peripheral portion of the recessed potion, thereby forming the decompressed space.

2. The liquid container according to claim 1, wherein:

the container body is formed of the liquid-containing bag;

the liquid-supplying section includes a first tube disposed adjacent to a base of the liquid-supplying section, the first tube being disposed in the liquid-containing bag, and having the recessed portion on an outer periphery of the first tube at a position a predetermined distance away from an edge of the liquid-containing bag toward the interior of the liquid-containing bag; and a portion of the liquid-containing bag located over the recessed portion being connected to a peripheral portion of the recessed portion so as to form an enclosed space serving as the decompressed space.

3. The liquid container according to claim 2, wherein the liquid-supplying section further includes:

a second tube disposed adjacent to a head of the liquid-supplying section, the second tube being connected to the first tube and protruding from the liquid-containing bag;

a flow channel connecting a supply port formed at a head end of the second tube and a discharge port formed at a base end of the first tube so as to guide the liquid inside the liquid-containing bag to the outside;

a check valve disposed on the flow channel adjacent to the discharge port so as to prevent backflow of the liquid from the supply port to the discharge port;

a bypass channel branched from the flow channel at a position between the check valve and the supply port and having an opening formed on the outer periphery of the first tube; and an on-off valve disposed at the supply port.

4. The liquid container according to claim 1, wherein an outer surface of the partition contacts the liquid stored in the container body.

5. The liquid container according to claim 1, wherein the decompressed space is substantially free from liquid previously stored in the container body.

6. The liquid container according to claim 1, wherein the decompressed space is configured to reduce the amount of gas dissolved in liquid that is supplied to the liquid-consuming apparatus.

* * * * *